US011623844B2

(12) United States Patent
Henneau et al.

(10) Patent No.: US 11,623,844 B2
(45) Date of Patent: Apr. 11, 2023

(54) ELEVATOR WITH A MONITORING ARRANGEMENT FOR MONITORING AN INTEGRITY OF SUSPENSION MEMBERS WITH SEPARATED CIRCUITRIES

(71) Applicant: Inventio AG, Hergiswil (CH)

(72) Inventors: Philippe Henneau, Zürich (CH); Kurt Heinz, Buchs (CH)

(73) Assignee: INVENTIO AG, Hergiswil NW (CH)

( * ) Notice: Subject to any disclaimer, the term of this patent is extended or adjusted under 35 U.S.C. 154(b) by 744 days.

(21) Appl. No.: 16/611,534

(22) PCT Filed: Jun. 1, 2018

(86) PCT No.: PCT/EP2018/064402
§ 371 (c)(1),
(2) Date: Nov. 7, 2019

(87) PCT Pub. No.: WO2018/234008
PCT Pub. Date: Dec. 27, 2018

(65) Prior Publication Data

US 2020/0207583 A1 Jul. 2, 2020

(30) Foreign Application Priority Data

Jun. 21, 2017 (EP) ..... 17177132

(51) Int. Cl.
*B66B 7/12* (2006.01)
*B66B 5/00* (2006.01)

(52) U.S. Cl.
CPC ..... *B66B 7/1223* (2013.01); *B66B 5/0031* (2013.01)

(58) Field of Classification Search
CPC ..... B66B 7/1223; B66B 5/0031; B66B 5/00; B66B 5/0018
See application file for complete search history.

(56) References Cited

U.S. PATENT DOCUMENTS 6,289,742 B1 9/2001 De Angelis
6,422,088 B1 * 7/2002 Oba ..... G01R 17/10 73/754

(Continued)

FOREIGN PATENT DOCUMENTS

CN 1262357 A 1/2000
CN 103086213 A 5/2013

(Continued)

OTHER PUBLICATIONS

Huaming Lei et al.: "Health Monitoring for Coated Steel Belts in an Elevator System." Journal of Sensors, vol. 2012, 5 pages, doi: 10.1155/2012/750261.

*Primary Examiner* — Michael A Riegelman
(74) *Attorney, Agent, or Firm* — William J. Clemens; Shumaker, Loop & Kendrick, LLP

(57) ABSTRACT

An elevator suspension member arrangement includes a monitoring arrangement monitoring an integrity status of suspension members having electrically conductive cords. The monitoring arrangement includes: a generator generating phase shifted first and second alternating voltages; input and output connectors each establishing electrical contacts to cords in one of the suspension members; a voltage analyzer measuring and analyzing a neutral point voltage resulting from applying the first and second alternating voltages to first and second cords of the one suspension member; a supply circuitry having supply lines electrically interconnecting the generator with the input connectors; and a measurement circuitry including measurement lines electrically interconnecting the analyzer with at least one of the input connectors and the output connectors. The supply and measurement lines are separated from each other whereby disturbing influences of impedances through the supply (Continued)

circuitry is minimized due to voltage measurements being performed through the separate measurement circuitry.

10 Claims, 5 Drawing Sheets

(56) References Cited

U.S. PATENT DOCUMENTS

| | | | | |
|---|---|---|---|---|
| 7,123,030 | B2 * | 10/2006 | Robar | G01N 27/82 324/693 |
| 7,506,728 | B2 * | 3/2009 | Hawkes | H01R 4/5033 187/277 |
| 8,011,479 | B2 * | 9/2011 | Stucky | B66B 7/1223 187/391 |
| 8,424,653 | B2 * | 4/2013 | Stucky | B66B 7/1223 187/391 |
| 8,686,747 | B2 * | 4/2014 | Berner | B66B 7/1223 187/391 |
| 8,813,918 | B2 * | 8/2014 | Kocher | B66B 7/1223 324/693 |
| 9,932,203 | B2 * | 4/2018 | Robibero | B66B 5/00 |
| 11,078,047 | B2 * | 8/2021 | Robibero | G01N 27/20 |
| 2008/0001479 | A1 * | 1/2008 | Dengel | H02J 3/38 307/34 |
| 2008/0223668 | A1 * | 9/2008 | Stucky | B66B 7/1223 187/393 |
| 2011/0253487 | A1 * | 10/2011 | Kocher | B66B 7/1223 187/393 |
| 2011/0284331 | A1 * | 11/2011 | Stucky | B66B 7/1223 187/393 |
| 2013/0207668 | A1 * | 8/2013 | Fargo | G01N 27/046 324/705 |
| 2015/0362450 | A1 * | 12/2015 | Lehtinen | G01N 27/20 187/391 |
| 2016/0002006 | A1 * | 1/2016 | Sun | G01R 17/00 187/254 |
| 2017/0029249 | A1 * | 2/2017 | Robibero | G01M 5/0091 |
| 2018/0215585 | A1 * | 8/2018 | Robibero | G01R 31/008 |
| 2019/0263628 | A1 * | 8/2019 | Sonnenmoser | B66B 5/0018 |
| 2019/0337761 | A1 * | 11/2019 | Robibero | B66B 7/1223 |
| 2020/0172375 | A1 * | 6/2020 | Henneau | B66B 5/0093 |
| 2020/0207583 | A1 * | 7/2020 | Heneau | B66B 7/1223 |
| 2021/0323790 | A1 * | 10/2021 | Robibero | G01R 31/081 |

FOREIGN PATENT DOCUMENTS

| | | | |
|---|---|---|---|
| EP | 1730066 | B1 | 10/2010 |
| EP | 1732837 | B1 | 4/2011 |
| EP | 3124425 | A1 | 2/2017 |
| EP | 3124986 | A1 | 2/2017 |
| JP | 6009395 | B2 | 10/2016 |
| WO | 2011098847 | A1 | 8/2011 |
| WO | 2013135285 | A1 | 9/2013 |
| WO | 2017021263 | A1 | 2/2017 |
| WO | 2017137282 | A1 | 8/2017 |
| WO | 2017137307 | A1 | 8/2017 |
| WO | 2018141553 | A1 | 8/2018 |

* cited by examiner

ELEVATOR WITH A MONITORING ARRANGEMENT FOR MONITORING AN INTEGRITY OF SUSPENSION MEMBERS WITH SEPARATED CIRCUITRIES

FIELD

The present invention relates to an elevator with a monitoring arrangement for monitoring an integrity of suspension members in a suspension member arrangement.

BACKGROUND

Elevators typically comprise a car and, optionally, a counterweight which may be displaced for example within an elevator shaft or hoistway to different levels in order to transport persons or items for example to various floors within a building.

In a common type of elevators, the car and/or the counterweight are supported by a suspension member arrangement comprising several suspension member entities. A suspension member entity typically comprises a suspension member, a fixation arrangement for fixing the suspension member within the building and possibly other components which may be used e.g. upon monitoring an integrity of the suspension member. A suspension member may be a member which may carry heavy loads in a tension direction and which may be bent in a direction transverse to the tension direction. For example, a suspension member may be a rope or a belt. Typically, suspension members comprise a plurality of load carrying cords. The cords may be made for example with an electrically conductive material, particularly a metal such as steel. Such cords are typically embedded into an electrically isolating matrix material such as a polymer, the matrix material, inter alia, protecting the cords against e.g. mechanical damaging and/or corrosion.

During operation of the elevator, suspension members have to carry high loads and are typically repeatedly bent when running along for example a traction sheave, a pulley and/or other types of sheaves. Accordingly, substantial physical stress is applied to the suspension members during operation which may lead to deteriorations in the suspension members' physical characteristics such as e.g. their load bearing capability.

However, as elevators may typically be used by people for transportation along significant heights, safety requirements have to be fulfilled. For example, it has to be safeguarded that the suspension member arrangement can always guarantee safe support of the car and/or the counterweight. For such purposes, safety regulations rule for example that substantial deterioration of an initial load bearing capacity of a suspension member arrangement can be detected such that for example counter-measures such as replacing a substantially deteriorated or faulty suspension member from the suspension member arrangement may be initiated.

For example, various approaches to be used upon monitoring suspension members in an elevator have been described in EP 1 730 066 B1, U.S. Pat. No. 7,123,030 B2, US 2011/0284331 A1, U.S. Pat. No. 8,424,653 B2, US 2008/0223668 A1, U.S. Pat. No. 8,011,479 B2, US 2013/0207668 A1, WO 2011/098847 A1, WO 2013/135285 A1, EP 1 732 837 B1, and in a research article of Huaming Lei et al.: "Health Monitoring for Coated Steel Belts in an Elevator System" in the Journal of Sensors, Volume 2012, Article ID 750261, 5 pages, doi: 10.1155/2012/750261. Most of these prior art approaches are generally based on measuring electrical resistance characteristics upon applying an electrical direct current (DC).

Further approaches for methods and devices for detecting deteriorations in load bearing suspension members of an elevator have been proposed by the present applicant, these approaches relying on AC voltage measurements. These approaches have been described by the present applicant inter alia in PCT/EP2016/067966, EP 16155357.3, EP 16155358.1, PCT/EP2017/052064, PCT/EP2017/052281 and EP 17166927. Furthermore, the applicant of the present application has filed a US provisional application U.S. 62/199,375 and a US non-provisional application U.S. Ser. No. 14/814,558 (now U.S. Pat. No. 9,932,203 B2) which relate to a more generalized approach for determining deteriorations in a suspension member arrangement for an elevator. All these documents are herein later on referred to as "the applicant's prior art". It shall be emphasized that many technical details of the "applicant's prior art" may also be applied to the present invention and that some technical characteristics of the present invention may be better understood upon studying "the applicant's prior art". Accordingly, the content of the "applicant's prior art" shall be incorporated herein by reference.

In some of the approaches used for monitoring a deterioration state in suspension members, particularly in those approaches described in the applicant's prior art, electrical AC voltages have to be applied to various cords within the suspension members and resulting voltages after transmission through the various cords, particularly resulting neutral point voltages, are to be measured. For such purpose, connectors are generally attached to a suspension member and electrically contact the cords embedded therein. The connectors are then interconnected with an alternating voltage generator arrangement and a voltage analyzer arrangement, respectively.

SUMMARY

There may be a need for an improvement in and/or an alternative for an elevator and a monitoring arrangement to be used in such elevator for monitoring an integrity status of a suspension member arrangement. Particularly, there may be a need for improved voltage measurement and analysis capabilities of the monitoring arrangement.

According to a first aspect of the invention, an elevator comprises a suspension member arrangement and a specific monitoring arrangement. The suspension member arrangement comprises a plurality of suspension members, each suspension member comprising electrically conductive cords. The monitoring arrangement is configured for monitoring an integrity status of the suspension member arrangement. Particularly, the monitoring arrangement comprises an alternating voltage generator arrangement, a plurality of input connectors and output connectors, a voltage analyzer arrangement and a supply circuitry and a measurement circuitry. The alternating voltage generator arrangement comprises at least one alternating voltage generator for generating at least first and second alternating voltages being phase shifted with respect to each other, preferably with a phase-shift of 180°. Each of the plurality of input connectors and output connectors establishes electrical contacts to cords comprised in one of the suspension members. The voltage analyzer arrangement comprises at least one voltmeter and is configured for measuring and analyzing a neutral point voltage resulting upon applying each one of the first and second alternating voltages to first and second cords, or groups of cords, of at least one of the suspension members, respectively, and after transmission of the first and second alternating voltages through the cords and superposition of the transmitted first and second alternating voltages at a neutral point at which the first and second cords are electrically interconnected. The supply circuitry comprises electrically conductive supply lines such as wires or cables electrically interconnecting the at least one alternating voltage generator with the input connectors. The measurement circuitry comprises electrically conductive measurement lines electrically interconnecting the at least one voltmeter with at least one of the input connectors and the output connectors. Therein, the supply lines and the measurement lines are separated from each other.

According to a second aspect of the invention, a monitoring arrangement for monitoring an integrity status of the suspension member arrangement of an elevator is proposed. Therein, the suspension member arrangement and the monitoring arrangement are provided with features as correspondingly defined above with respect to the first aspect of the invention.

Ideas underlying embodiments of the present invention may be interpreted as being based, inter alia and without restricting a scope of the invention, on the following observations and recognitions:

As indicated in the introductory portion further above, inventors of the applicant have developed various details of an approach for monitoring an integrity status of a suspension member arrangement in an elevator (see "applicant's prior art"), wherein alternating voltages being phase-shifted with respect to each other are applied to various cords or groups of cords in the suspension member arrangement. In all such approaches, a first alternating voltage is applied to a first group of cords and a second phase-shifted alternating voltage is applied to a second group of cords in the same or another one of the suspension members. The first and second groups of cords are then electrically interconnected such that, at a location which is generally referred to as "neutral point", a superposition of the applied first and second alternating voltages after transmission through the first and second group of cords, respectively, may be measured. The voltage resulting from such superposition is typically referred to as neutral point voltage. Analyzing such neutral point voltage may provide valuable information about a current integrity status of the suspension member arrangement. For example, an increase in an electrical resistance of one of the cords due to for example local corrosion or even an interruption of one of the cords may reliably be revealed upon analyzing the neutral point voltage. Similarly, short-circuits between cords and/or electrical connections between a cord and for example an electrically conductive pulley or sheave may be detected.

In the prior implementations of monitoring devices, the alternating voltages were generated by one or more alternating voltage generators which were electrically connected to the cords or groups of cords via input circuitries and input connectors electrically connected to input ends of the cords or groups of cords. Output ends of the cords or groups of cords were electrically interconnected via output connectors and an output circuitry such as to form the neutral point, i.e. for superimposing the resulting alternating voltages occurring at these output ends. In order to enable measuring the neutral point voltage and, optionally, further resulting voltages providing information about the current integrity state of the suspension members, the monitoring device comprised at least one voltmeter, or preferably a plurality of voltmeters, for measuring the resulting voltages. Conventionally, for the sake of simplicity of circuitries in the monitoring device, these voltmeters were electrically connected to the cords in the suspension members via the same input circuitry used for supplying the alternating voltages and/or the same output circuitry used for interconnecting the output ends of the cords at the neutral point.

It has now been found that with embodiments of the present invention, the prior art approaches may be improved at least in some respects. Particularly, a measurement of resulting voltages, particularly of the neutral point voltage, may be simplified and/or a reliability upon detecting any deteriorations in the integrity status of the suspension member arrangement may be increased.

The monitoring arrangement included in an elevator according to embodiments of the present invention comprises an alternating voltage generator arrangement, several connectors and a voltage analyzer arrangement. The alternating voltage generator arrangement, the voltage analyzer arrangement and the connectors may in general be similar or identical to corresponding arrangements as applied in the applicant's prior art approaches.

Particularly, the alternating voltage generator arrangement may for example comprise two alternating voltage generators for generating the first and second alternating voltages which may have a same waveform, i.e. inter-alia same frequency and same amplitude, but which are phase-shifted by e.g. 180° with respect to each other. Alternatively, the alternating voltage generator arrangement may comprise a single alternating voltage generator having two output ports with a second output port outputting an inversed alternating voltage, i.e. an alternating voltage being offset by a 180° phase-shift with respect to an alternating voltage output at a first output port.

The voltage analyzer arrangement may comprise one, two or more voltmeters for measuring an electrical voltage at the neutral point, i.e. the neutral point voltage resulting upon superimposing the first alternating voltage after transmission through a first group of cords with the second alternating voltage after transmission through a second group of cords. The neutral point voltage may be measured e.g. with reference to a predetermined electrical potential such as a ground potential. Alternatively, the neutral point voltage may be measured along a reference electrical resistance. One or both of a DC component and an AC component of the neutral point voltage may be measured. Details on possible implementations of the voltage analyzer arrangement may be obtained from the applicant's prior art.

The approach of the present invention differs from prior art approaches particularly with respect to supply circuitries interconnecting the alternating voltage generator(s) of the alternating voltage generator arrangement with the cords of the suspension member arrangement and/or with respect to the measurement circuitries interconnecting the voltmeter(s) of the voltage analyzer arrangement with the cords of the suspension member arrangement. Particularly, the supply circuitries shall use other electrically conductive lines, referred to herein as supply lines, than the measurement circuitries, the electrically conductive lines of which are referred to herein as measurement lines.

In other words, in the prior art approaches, a circuit or loop comprising the voltage generator arrangement connected to an input end of cords or groups of cords which, at an opposing output end, are interconnected to form a neutral point used the same electrically conductive lines as used for electrically connecting the voltmeter(s) of the voltage analyzer arrangement to the input end and/or output end of the cords or groups of cords.

However, it has been found that, in order to enable measuring substantive voltages or changes of voltages upon a varying voltage drop along the cords or groups of cords, substantive electrical currents have to be transmitted through the entire circuit or loop. However, such substantive electrical currents do not only result in additional substantive voltage drops along the cords or groups of cords but, generally, also result in substantive voltage drop along the supply circuitry and/or measurement circuitry. Such additional substantive voltage drops may hinder an analysis of the measured voltages and, as a consequence, may render an analysis of the current integrity status of the suspension member based on such measured resulting voltages difficult and/or not sufficiently reliable.

It is therefore proposed herein to modify the circuitries within the monitoring arrangement. Particularly, it is proposed to use separate supply lines and measurement lines for establishing a supply circuitry for electrical interconnection of the cords in the suspension members with the voltage generator arrangement, in the case of the supply lines, and for establishing measurement circuitries for electrical interconnection of the cords in the suspension members with the voltmeters of the voltage analyzer arrangement, in the case of the measurement lines.

With the approach described herein, while the wiring of the supply circuitry and the measurement circuitry may become slightly more complex than in prior approaches, it may allow simpler and more reliable analysis of measured resulting voltages. Particularly, substantial impedances occurring in the supply lines upon transmitting substantial electric currents through these supply lines may not or less influence the voltage measurements, as the voltmeters are not, or at least not only, connected to the cords of the suspension members via the supply lines but via separate measurement lines.

According to an embodiment, the input connectors and output connectors interconnect a group of plural cords in parallel to each other.

Interconnecting plural cords in parallel forming one group of cords may enable monitoring the integrity of all cords in such group simultaneously. Furthermore, as explained in more detail in the applicant's prior art, such parallel interconnection scheme may result in further advantages such as, inter-alia, allowing use of simplified connectors and/or circuitry. However, in such case of plural cords being interconnected in parallel, an overall electrical resistance through the cords may become very low. Accordingly, measuring a voltage drop resulting upon transmitting the applied first and second alternating voltages through the groups of cords may be difficult, as such voltage drop may be relatively small. Particularly, measuring variations in such voltage drop resulting from any deterioration of the electrical properties in the groups of cords may be challenging.

Accordingly, in such parallel interconnection scheme, the alternating voltage generator arrangement is typically adapted for generating substantially high electric currents throughout the circuitry loop comprising the groups of cords. However, upon such substantial electric currents, not only the voltage drops throughout the groups of cords increase but also voltage drops throughout the circuitries of the monitoring arrangement increase.

Accordingly, it may be specifically beneficial in such parallel interconnection scheme to separate a voltage supply via the supply lines, on the one hand, from a voltage measurement via the measurement lines, on the other hand.

According to another embodiment, an electrical resistance through one of the supply lines is non-negligible compared to an electrical resistance through the cords contacted by this supply line and electrically series-connected to this supply line.

In other words, there is generally a series-interconnection between the supply lines connected to the voltage generator arrangement and the group of cords to which a generated alternating voltage is to be applied. Both, the supply lines and the groups of cords have some electrical resistance. Accordingly, voltage drops occur along each of both parts of the series-interconnection. Conventionally, if resulting voltages are measured along the combination of both parts of the series-interconnection, the electrical resistance through the supply line may significantly influence an overall voltage measurement results.

In order to avoid or minimize such influence, the electrical resistance of the supply line would have to be significantly reduced. For example, a cross-section of the supply line could be increased. However, the supply line established e.g. with a wire having a large diameter generally may generate other problems such as increased costs and/or may be more difficult to be applied in an elevator.

With the modified approach described herein, the measurement of the resulting voltages is not performed through the series-connection of the supply line and the group of cords. Instead, such measurement is performed through a series-connection of the separate measurement line and the group of cords. Therein, no substantial electric currents have to be transmitted through such series-connection during the voltage measurement. Accordingly, any substantial electrical resistance through the measurement line will not substantially influence the measurement of the resulting voltages throughout the group of cords.

On the other hand, the electrical resistance through the supply line may be non-negligible, as the voltage measurement is not performed throughout this supply line and, therefore, any voltage drops throughout the supply line do not negatively influence the voltage measurement. In this context, non-negligible means that the electrical resistance through the supply line may be at least 5%, preferably at least 10%, at least 20% or at least 50%, of the electrical resistance through the group of cords contacted by this supply line.

According to an embodiment, the supply lines may have a length of at least 0.2 m, preferably of at least 0.5 m, at least 1 m or at least 5 m.

As indicated with respect to the preceding embodiment, electrical resistances throughout the supply lines may not influence any voltage measurement as it is proposed herein to perform such voltage measurement not throughout the supply line but throughout separate measurement lines connected to the groups of cords in the suspension member. Accordingly, in contrast to prior implementations of monitoring devices, the length of such supply lines does not need to be kept as short as possible in order to realize low electrical resistances. Instead, such supply lines may be relatively long and may therefore be easily manufactured, installed and/or located in the elevator and its monitoring arrangement without having to worry about any substantial electrical resistance contribution.

According to an embodiment, the alternating voltage generator arrangement and the voltage analyzer arrangement are configured such that electric currents through the supply lines are stronger, preferably substantially stronger, than electric currents through the measurement lines.

In other words, the alternating voltage generator arrangement, which is connected to the cords of the suspension member via the supply lines, may be configured for generating the first and second alternating voltages at relatively high currents or amperage whereas the voltage analyzer arrangement, which is connected to the cords of the suspension member via the measurement lines, allows measuring the voltages at much lower currents or amperage.

For example, the electric currents through the supply lines may be at least five times, preferably at least ten times or at least fifty times, stronger than the electric currents through the measurement lines.

According to an embodiment, the supply lines may have a larger cross-section than the measurement lines.

For example, a wire or cable forming a supply line may have a larger diameter than a wire or cable forming a measurement line as the electric currents to be transmitted through the supply line are intended to be significantly larger than the electric currents to be transmitted through the measurement line. Accordingly, electric losses may be reduced. For example, the cross section of the supply line may be at least double, at least five times or at least ten times the cross section of the measurement line.

According to an embodiment, first ends of the supply lines are connected to the at least one voltage generator and first ends of the measurement lines are connected to the at least one voltmeter, and second ends of both the supply lines and the measurement lines are each directly connected to one of the input connectors and output connectors.

In other words, while the supply lines and the measurement lines are provided as separate lines and first ends thereof are connected to different components, i.e. to the voltage generator, in the case of the supply lines, and to the voltmeter, in the case of the measurement lines, the opposite second ends of both types of lines may be connected to a common one of the input connectors and the output connectors. Therein, the second ends of a line pair including one measurement line and one supply line may both be directly connected to the common connector. In such case, both the supply line and the measurement line of such pair generally extend from the respective component of the monitoring arrangement, i.e. from the voltage generator or from the voltmeter, respectively, directly to the connector attached to the suspension member.

According to an alternative embodiment, first ends of the supply lines are connected to the at least one voltage generator and first ends of the measurement lines are connected to the at least one voltmeter, and second ends of both the supply lines and the measurement lines are connected to each other before being commonly connected via a connector line to one of the input connectors and output connectors.

In other words, in such case, the supply line and the measurement line which shall both be electrically connected to a common one of the input connectors and output connectors do not both extend directly to the common connector. Instead, both lines of such pair may extend only along a part of a distance between the contacted components of the monitoring arrangement, on the one side, and the common connector, on the other side, as separate lines and are then interconnected with each other such that the remaining part of the distance is bridged with the common connector line.

Optionally, this connector line may be a portion of one of the supply line and the measurement line. I.e. one of these lines is connected to the other one of these lines at a location being spaced apart from the common connector while the other one of these lines extends directly to the common connector.

In such implementation, for example internal to the monitoring arrangement, the supply lines and the measurement lines may be provided as separate lines, whereas a distance between the monitoring arrangement and the common connector attached to the suspension member is bridged by the common connector line. Thereby, particularly a wiring between the monitoring arrangement and the suspension member arrangement may be simplified.

It shall be noted that possible features and advantages of embodiments of the invention are described herein partly with respect to an elevator comprising a monitoring arrangement and partly with respect to the monitoring arrangement itself. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention.

The figures are only schematic representations and are not to scale. Same reference signs refer to same or similar features throughout the figures.

DETAILED DESCRIPTION

Figure 1:
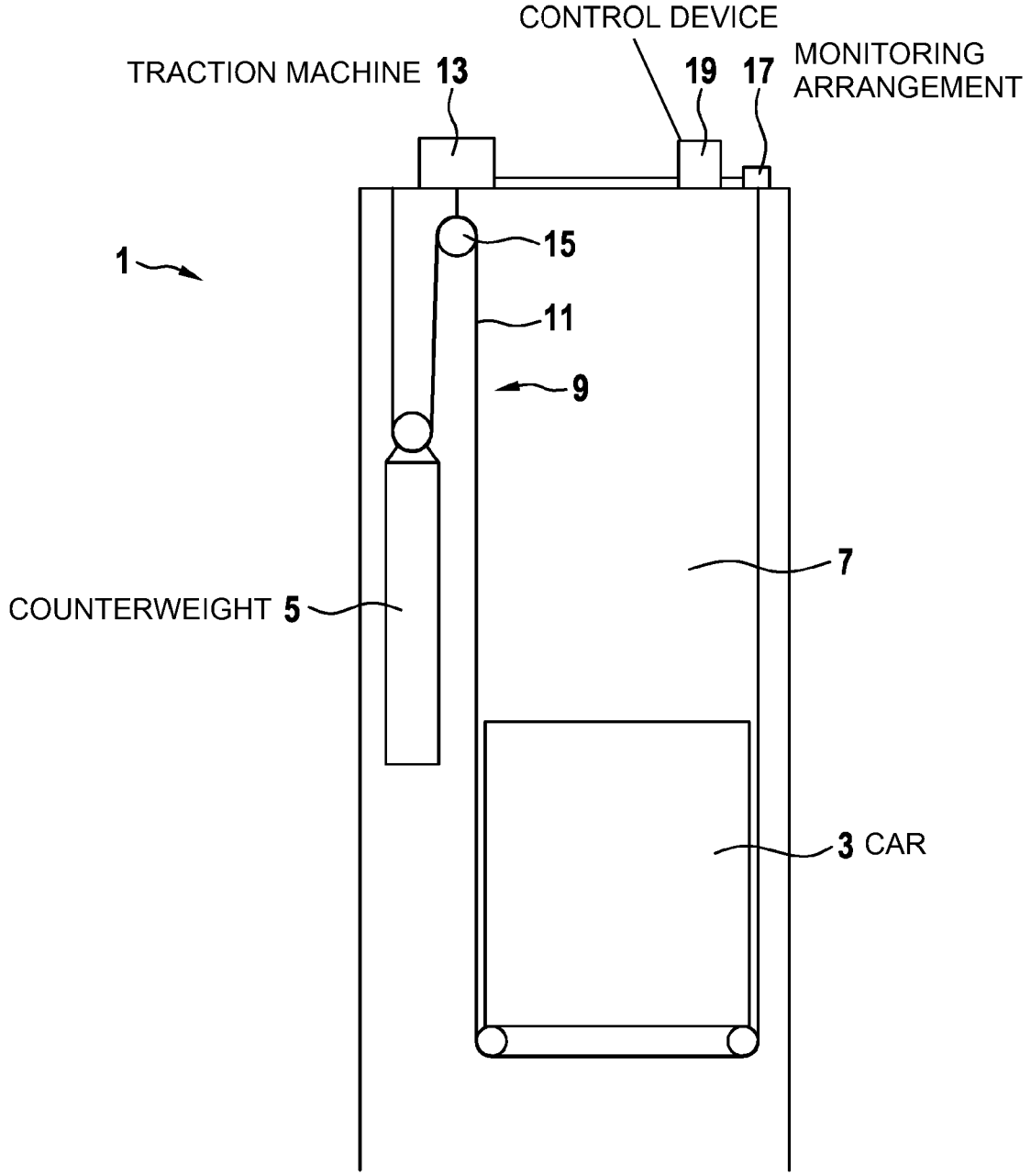
FIG. 1 shows an elevator in which a monitoring arrangement according to an embodiment of the invention may be applied.

FIG. 1 shows an elevator 1 in which a monitoring arrangement 17 may be implemented in accordance with embodiments of the present invention.

The elevator 1 comprises a car 3 and a counterweight 5 which may be displaced vertically within an elevator shaft 7. The car 3 and the counterweight 5 are suspended by a suspension member arrangement 9. This suspension member arrangement 9 comprises multiple suspension members 11, sometimes also referred to as suspension traction media (STM). Such suspension members 11 may be for example ropes, belts, etc. Furthermore, the elevator 1 comprises additional components such as, inter-alia, the monitoring arrangement 17 for monitoring an integrity or deterioration status of the suspension members 11 in the suspension member arrangement 9.

In the example shown in FIG. 1, end portions of the suspension members 11 are fixed to a supporting structure of the elevator 1 at a top of the elevator shaft 7. The suspension members 11 may be displaced using an elevator traction machine 13 driving a traction sheave 15. An operation of the elevator traction machine 13 may be controlled by a control device 19.

It may be noted that the elevator 1 and particularly its suspension member(s) 11 and its monitoring arrangement 17 for detecting the deterioration status may be configured and arranged in various other ways than those shown in FIG. 1. For example, instead of being fixed to the support structure of the elevator 1, the end portions of the suspension members 11 may be fixed to the car 3 and/or to the counterweight 5.

The suspension members 11 may utilize metal cords or ropes to support a suspended load such as the car 3 and/or the counterweight 5 that is moved by the traction machine 13. The cords or ropes may be enclosed in a sheath or cover comprising e.g. a polymer matrix material for protecting the cords or ropes against wear and/or corrosion.

Figure 2:
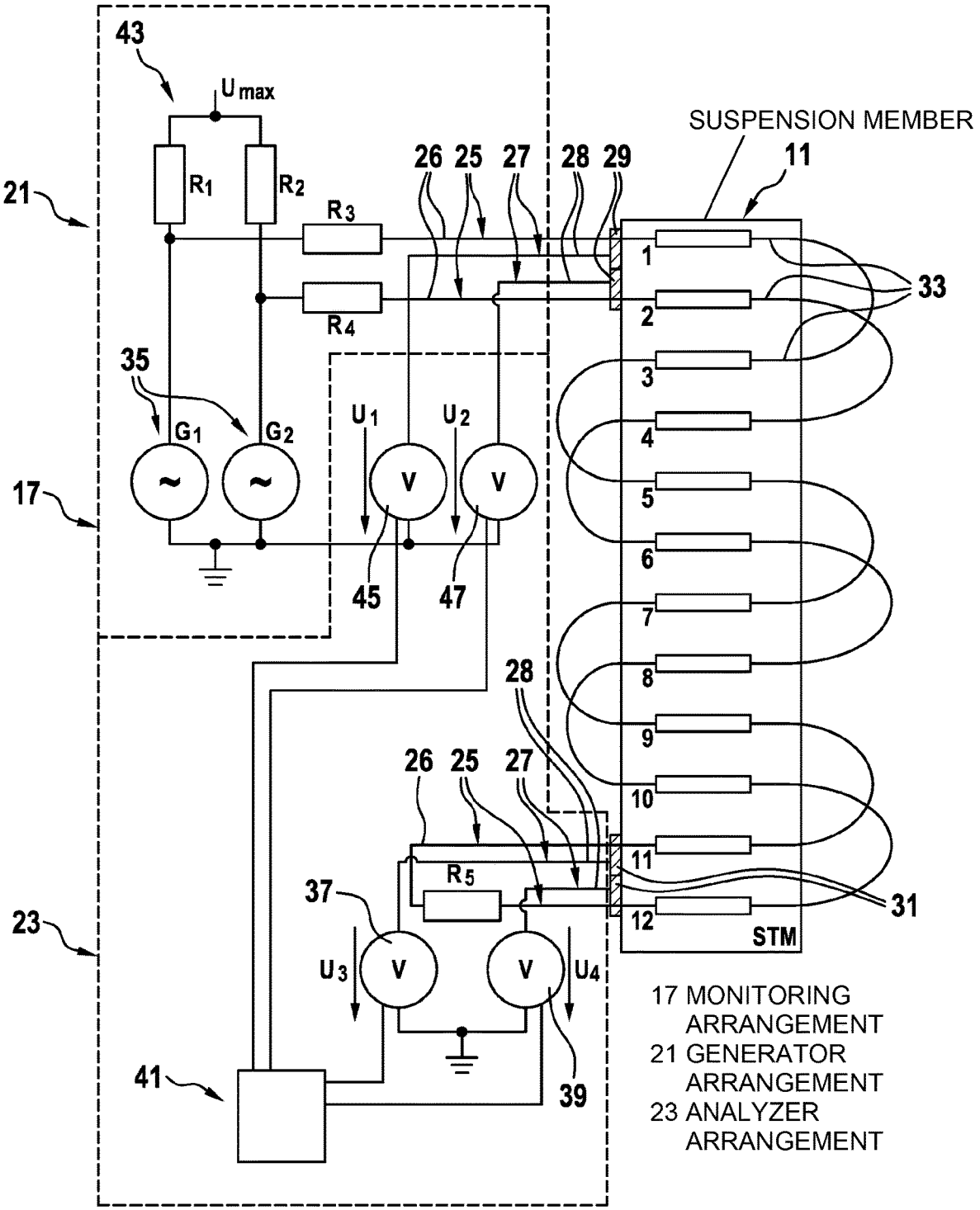
FIGS. 2 to 5 show monitoring arrangements according to various embodiments of the invention as applied to a suspension member arrangement.

FIG. 2 schematically shows main features of a first embodiment of a monitoring arrangement 17 for monitoring an integrity status of one or more suspension members 11. Details on possible operation principles of the monitoring arrangement 17 are disclosed in the "applicant's prior art" (for example an overview is given in PCT/EP2016/067966) and shall only be briefly summarized herein.

The monitoring arrangement 17 comprises an alternating voltage generator arrangement 21 and a voltage analyzer arrangement 23. Furthermore, the monitoring arrangement 17 comprises some supply circuitry 25 including electrically conductive supply lines 26 and some measurement circuitry 27 including measurement lines 28 as well as some input connectors 29 and output connectors 31 for applying the voltages generated by the alternating voltage generator arrangement 21 to cords 33 of one or more suspension members 11 and for forwarding resulting voltages after transmission through the cords 33 towards the voltage analyzer arrangement 23.

In more detail, the voltage generator arrangement 21 comprises two alternating voltage generators 35 ($G_1$, $G_2$) for generating a first and a second alternating voltage. Preferably, the two alternating voltages have same waveforms but are phase shifted by 180° with respect to each other. The generated alternating voltages may have no DC component, i.e. the voltage is symmetrically alternating around 0V. Alternatively, the generated alternating voltages may have an additional DC component, i.e. the voltage is periodically alternating around a non-zero DC voltage. The first and second alternating voltages are applied to two different cords 33 or groups of cords 33 being interconnected in series and/or in parallel within one or more suspension members 11. For this purpose, the alternating voltage generators 35 are each connected via the supply circuitry 25 including internal resistances (being represented as resistances $R_3$ and $R_4$) to two separate input connectors 29 each contacting first ends of one or more of the cords 33 comprised in first and second groups of cords 33. The internal resistances $R_3$ and $R_4$ may be established due to intrinsic series resistances throughout wirings forming the supply lines.

Furthermore, the opposing second ends of the two or more the cords 33 or groups of cords are interconnected via another portion of the supply circuitry 25 and an electrical resistance $R_5$ thereby forming a neutral point in the entire circuitry.

Additionally, the alternating voltage generator arrangement 21 comprises a pull-up voltage source 43 for applying a pull-up voltage $U_{max}$ via internal resistors $R_1$, $R_2$ to associated branches of the input circuitry 25.

It shall be noted that, in the example shown in the figure, all odd numbered cords 1, 3, 5, . . . , 11 are connected in series to form a first group of cords 33 and all even numbered cords 2, 4, 6, . . . , 12 are connected in series to form a second group of cords 33. However, such configuration is only exemplary. Various other configurations of grouping cords 33 into first and second groups are imaginable. For example, a first group of cords 33 may comprise all cords of a single suspension member 11 and a second group of cords 33 may comprise all cords of another single suspension member 11, the cords 33 of a group being interconnected in parallel or some of the cords 33 of a group being interconnected in parallel and being serially connected to another portion of the group of cords 33.

The applied voltages are transmitted through the cords 33 or groups of cords. At the opposing ends, the cords 33 or groups of cords are connected via two separate output connectors 31 and via the measurement circuitry 27 to components of the voltage analyzer arrangement 23. A portion of the measurement circuitry 27 is also connected to the input connectors 29.

Particularly, the voltage analyzer arrangement 23 comprises various voltmeters 37, 39, 45, 47 and is adapted for measuring, inter-alia, the neutral point voltage resulting upon superimposing the resulting alternating voltages occurring at the ends of the cords 33 or groups of cords after transmission through the entire circuit comprising the cords 33 in the suspension member(s) 11 and well as the supply circuitry 25 including the supply lines 26. The resulting superimposed voltage is referred to as neutral point voltage, as, at the neutral point, both shifted alternating voltages should neutralize each other as long as electrical characteristics through the cords or groups of cords are same. Accordingly, under normal circumstances, the neutral point voltage should have a zero alternating voltage component.

However, upon any deteriorations in the cords 33 modifying their electrical characteristics, such modifications generally lead to a lacking complete neutralization of the phase-shifted alternating voltages, such that the resulting non-zero neutral point voltage may serve as a good indicator for any change in an integrity status of the suspension member arrangement 9.

In the example shown in FIG. 2, the neutral point voltage is indirectly measured based on the measurements of two voltages $U_3$ and $U_4$ against ground potential using voltmeters 37, 39. Therein, one voltmeter 37 is connected via the measurement circuitry 27 including one measurement line 28 and one of the output connectors 31 to the first one of the groups of cords 33 whereas the other voltmeter 39 is connected via the measurement circuitry 27 including another measurement line 28 and another one of the output connectors 31 to the second one of the groups of cords 33. Separate to this measurement circuitry 27, both output connectors 31 are interconnected via a portion of the supply circuitry 25 including supply lines 26 and further including the electrical resistance $R_5$ thereby closing the loop between both groups of cords 33 and establishing the neutral point of the entire loop circuitry extending between both alternating voltage generators 35.

Measuring results of both voltmeters 37, 39 may be evaluated and analyzed by an analyzing unit 41. Accordingly, the analyzing unit 41 may detect a deterioration in the integrity status of the suspension member arrangement 9 based on the analysis of the neutral point voltage, particularly based on any deviation from a non-zero AC component of the neutral point voltage.

It shall be noted that other circuitry including one or more voltmeters and analyzing units may be applied for measuring the neutral point voltage, as described for example in more detail in the applicant's prior art.

Additionally to the neutral point voltage, the monitoring arrangement 17 may determine voltages which result after a voltage drop along cords 33 of one of the groups of cords and which are referred to herein as resulting voltages. The voltmeters 37, 39 measuring the voltages $U_3$, $U_4$ may enable measuring such resulting voltages, optionally additionally taking into account measurements of additional voltmeters 45, 47 measuring voltages $U_1$, $U_2$ as applied by the alternating voltage generator arrangement 21 to the input connectors 29. Also, the resulting voltages may be evaluated and analyzed by the analyzing unit 41.

Accordingly, the analyzing unit 41 may further detect a second type of deterioration in the integrity status of the suspension member arrangement 9 based on a detected modification in the measured resulting voltages, particularly based on any substantial deviations of currently measured values for such resulting voltages in comparison to initially measured (i.e. before any significant deterioration took place) values or reference values for such resulting voltages.

Accordingly, the monitoring arrangement 17 may detect two types of deteriorations in an integrity status of the suspension member 11. The first type relates e.g. to failures such as interruptions or electrical shorts in one of the groups of cords. This first type of deterioration may be detected based on an analysis of the neutral point voltage. The second type of deterioration particularly relates e.g. to wear effects in the cords 33 resulting in gradually increasing the electric resistance over time. The second type of deterioration may be detected based on an analysis of the resulting voltage drop along the cords 33.

An important feature distinguishing the monitoring arrangement proposed herein from prior art approaches may be seen in the fact that the functionality of power supply from the voltage generators 35 to the cords 33 comprised in the suspension member 11 is established through another circuitry, namely through the supply circuitry 25, than the functionality of voltage measurements using the voltmeters 37, 39, 45, 47, which is established via the measurement circuitry 27.

Specifically, power supply is established through the supply lines 26 connecting the voltage generators 35 with the input connectors 29, whereas voltage measurements are executed through measurement lines 28 each connecting one of the voltmeters 37, 39, 45, 47 with one of the input connectors 29 and output connectors 31. Accordingly, any voltage drops or impedances occurring throughout the supply circuitries 25, as indicated by the electrical resistors $R_3$, $R_4$, upon substantial electric currents being supplied by the voltage generators 35 may not substantially influence the voltage measurement functionality.

Figure 3:
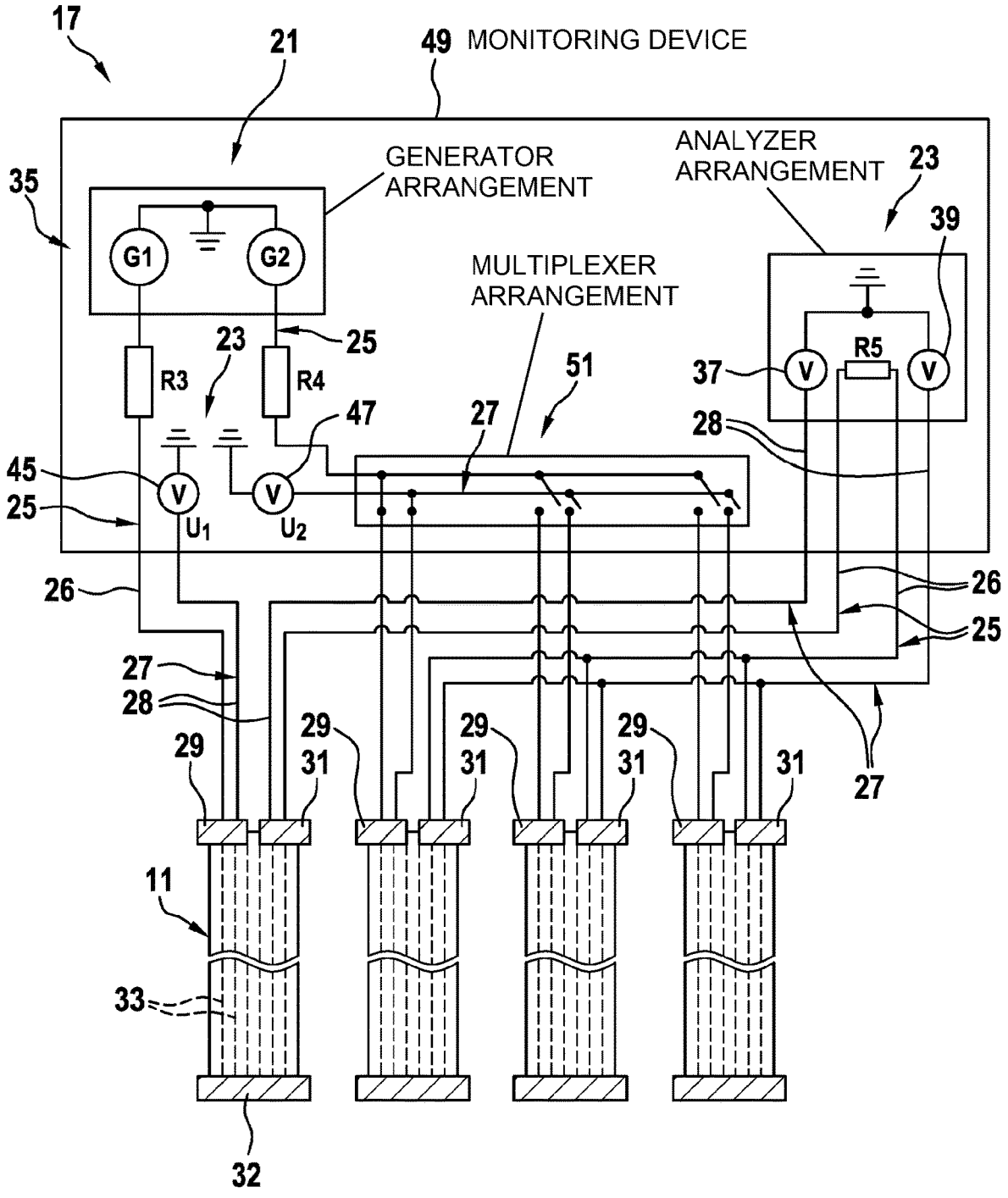

While FIG. 2 shows some details of a monitoring arrangement 17 monitoring an integrity of cords 33 in a single suspension member 11, the approach shown in FIG. 3 relates to an embodiment, in which a monitoring arrangement 17 is adapted for monitoring an integrity of cords 33 in multiple suspension members 11. Therein, the principle of alternating voltage generation and supply to the cords 33 via supply circuitries 25, on the one hand, and voltage measurements using voltmeters 37, 39, 45, 47 via measurement circuitries 27, on the other hand, is similar to the embodiment of FIG. 2. Again, substantial electric power is generated by the alternating voltage generators 35 and supplied through supply lines 26 being separate to measurement lines 28 via which voltage measurements may be performed with the voltmeters 37, 39, 45, 47.

Therein, the supply lines 26 and the measurement lines 28 do not only extend within a monitoring device 49 forming part of the monitoring arrangement 17 but also between the monitoring device 49 and the input and output connectors 29, 31 attached to each of the suspension members 11.

In order to be able to not only monitoring a single suspension member 11 but a plurality of suspension members 11, the monitoring arrangement 17 furthermore comprises a multiplexer arrangement 51. While a first suspension member 11 may be fixedly connected to the first alternating voltage generator $G_1$, the other suspension members 11 may be sequentially electrically connected to the other voltage generator $G_2$ using the multiplexer arrangement 51. Therein, the multiplexer arrangement 51 is not only adapted for selectively connecting portions of the supply circuitry 25 connected to the second voltage generator $G_2$ but also for selectively connecting portions of the measurement circuitry 27. Accordingly, the multiplexer arrangement 51 is configured for both, multiplexing a power supply provided by the alternating voltage generator arrangement 21 as well as multiplexing the measurement circuitry 27 for selectively connecting one of the voltmeters 37, 39 to the output connector 31 of one of the suspension members 11.

In the given example, each suspension member 11 may form a single circuitry for electrically connecting the alternating voltage generator arrangement 21 with the voltage analyzer arrangement 23. Therein, an input connector 29 contacts several but not all cords 33 comprised in this suspension member 11 and interconnects them in parallel. An output connector 31 contacts the remaining cords 33 of this suspension member 11 at the same end of the suspension member 11, i.e. the input connectors 29 and the output connector 31 are placed adjacent to each other at a first end of the suspension member 11 but are electrically separate from each other. At an opposite second end of the suspension member 11, an interconnecting connector 32 electrically interconnects all of the cords 33 of this suspension member 11. Further details on the interconnection scheme of such embodiment are described in the applicant's prior art.

Figure 4:
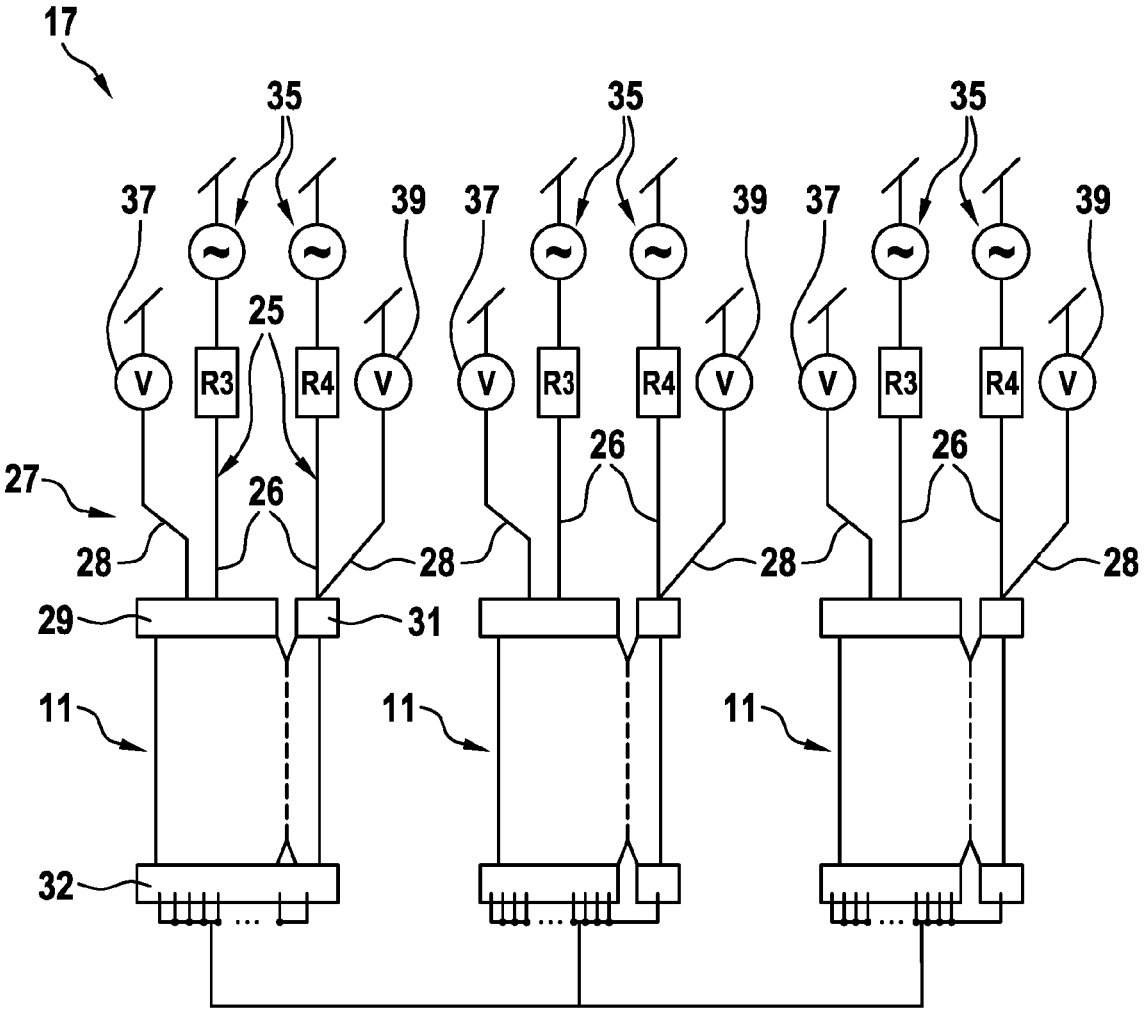
Figure 5:
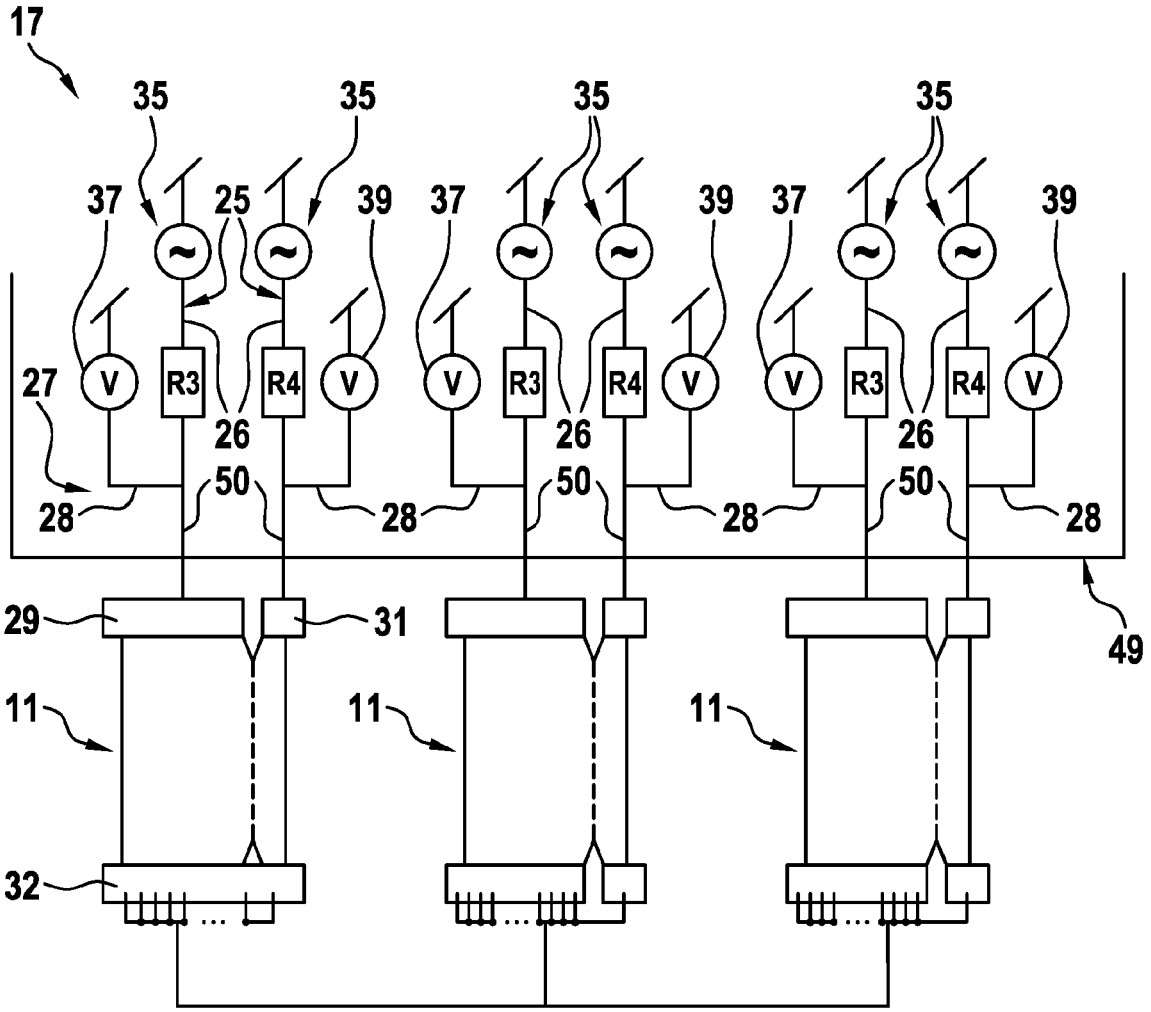

Another approach for monitoring the integrity of each of multiple suspension members 11 is depicted in the embodiments shown in FIGS. 4 and 5.

Therein, each of the suspension members 11 has its own alternating voltage generators 35 and its own voltmeters 37, 39 associated therewith. It is to be noted that FIGS. 4 and 5 are very schematic and mainly visualize some essential features of embodiments of the present invention relating to the separate supply and measurement circuitries 25, 27.

In both cases, supply lines 26 of the supply circuitries 25 and measurement lines 28 of the measurement circuitries 27 are at least partially separated from each other. Furthermore. in both cases, first ends of the supply lines 26 are connected to one of the voltage generators 35 and first ends of the measurement lines 28 are connected to one of the voltmeters 37, 39.

However, in the embodiment of FIG. 4, both the supply lines 26 and the measurement lines 28 are directly connected to the input and output connectors 29, 31. In other words, opposing second ends of the supply lines 26 and the measurement lines 28 are each directly connected to one of the input connectors 29 or one of the output connectors 31. Accordingly, the supply lines 26 and the measurement lines 28 are separate from each other not only within the monitoring device 49 but also in a region between the monitoring device 49 and the input and output connectors 29, 31.

In contrast hereto, in the embodiment of FIG. 5, the second ends of both the supply lines 26 and the measurement lines 28 are connected to each other at a location within the monitoring device 49 before being commonly connected via a connector line 50 one of the input and output connectors 29, 31. In other words, not both types of lines 26, 28 are directly connected to one of the input and output connectors 29, 31, but before reaching such connector, the two lines 26, 28 are already interconnected and the remaining distance is then bridged by the connector line 50. For example, internal to the monitoring device, the supply lines 26 and the measurement lines 28 are provided as separate wires or conductors, whereas external of the monitoring device, the functions of both types of lines 26, 28 are combined in the connector line 50.

Finally, it should be noted that the term "comprising" does not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator with a suspension member arrangement including a plurality of suspension members, each of the suspension members including electrically conductive cords, and a monitoring arrangement for monitoring an integrity status of the suspension member arrangement, the monitoring arrangement comprising:

an alternating voltage generator arrangement, including at least one alternating voltage generator, for generating first and second alternating voltages being phase shifted with respect to each other;

a plurality of input connectors and output connectors, each of the connectors establishing electrical contact to cords in one of the suspension members;

a voltage analyzer arrangement, including at least one voltmeter, for measuring and analyzing a neutral point voltage resulting upon applying each one of the first and second alternating voltages to first and second cords of the one suspension member, respectively, and after transmission of the first and second alternating voltages through the first and second cords and superposition of the transmitted first and second alternating voltages at a neutral point at which the first and second cords are electrically interconnected;

a supply circuitry including supply lines electrically interconnecting the alternating voltage generator arrangement with the input connectors and with the output connectors, and a measurement circuitry including measurement lines electrically interconnecting the voltage analyzer arrangement with at least one of the input connectors and the output connectors; and wherein the supply lines and the measurement lines are separate lines.

2. The elevator according to claim 1 wherein the input connectors and the output connectors interconnect a group of the cords in parallel to each other.

3. The elevator according to claim 1 wherein an electrical resistance through one of the supply lines is non-negligible compared to an electrical resistance through the cords contacted by the one supply line and electrically series-connected to the one supply line.

4. The elevator according to claim 1 wherein the supply lines each have a length of at least 0.2 m.

5. The elevator according to claim 1 wherein the alternating voltage generator arrangement and the voltage analyzer arrangement are configured such that electric currents transmitted through the supply lines by the application of the first and second alternating voltages are stronger than electric currents transmitted through the measurement lines by the application of the first and second alternating voltages.

6. The elevator according to claim 1 wherein the supply lines have a larger cross-section than a cross-section of the measurement lines.

7. The elevator according to claim 1 wherein first ends of the supply lines are connected to the alternating voltage generator arrangement and first ends of the measurement lines are connected to the voltage analyzer arrangement, and wherein second ends of the supply lines and second ends of the measurement lines are each directly connected to one of the input connectors or one of the output connectors.

8. The elevator according to claim 1 wherein first ends of the supply lines are connected to the alternating voltage generator arrangement and first ends of the measurement lines are connected to the voltage analyzer arrangement, and wherein second ends of both the supply lines and the measurement lines are connected to each other before being commonly connected via a connector line to one of the input connectors or one of the output connectors.

9. A monitoring arrangement for monitoring an integrity status of a suspension member arrangement of an elevator, the suspension member arrangement including a plurality of suspension members, each of the suspension member having electrically conductive cords, the monitoring arrangement comprising:

an alternating voltage generator arrangement including at least one alternating voltage generator for generating first and second alternating voltages being phase shifted with respect to each other;

a plurality of input connectors and output connectors, each of the connectors being configured for establishing electrical contact to the cords in one of the suspension members;

a voltage analyzer arrangement including at least one voltmeter, the voltage analyzer arrangement measuring and analyzing a neutral point voltage resulting upon applying each one of the first and second alternating voltages to first and second cords of at least one of the suspension members, respectively, the first and second cords being electrically interconnected at a neutral point, and after transmission of the first and second alternating voltages through the first and second cords and superposition of the transmitted first and second alternating voltages at the neutral point the neutral point voltage is generated;

a supply circuitry including supply lines electrically interconnecting the at least one alternating voltage generator with the input connectors and with the output connectors, and a measurement circuitry including measurement lines electrically interconnecting the at least one voltmeter with at least one of the input connectors and with the output connectors; and wherein the supply lines and the measurement lines are separate lines.

10. An elevator with a suspension member arrangement including a plurality of suspension members, each of the suspension members including electrically conductive cords, and a monitoring arrangement for monitoring an integrity status of the suspension member arrangement, the monitoring arrangement comprising:

an alternating voltage generator arrangement, including at least one alternating voltage generator, for generating first and second alternating voltages being phase shifted with respect to each other;

a plurality of input connectors and output connectors, each of the connectors establishing electrical contact to cords in one of the suspension members;

a voltage analyzer arrangement, including at least one voltmeter, for measuring and analyzing a neutral point voltage resulting upon applying each one of the first and second alternating voltages to first and second cords of the one suspension member, respectively, and after transmission of the first and second alternating voltages through the first and second cords and superposition of the transmitted first and second alternating voltages at a neutral point at which the first and second cords are electrically interconnected;

a supply circuitry including supply lines electrically interconnecting the alternating voltage generator arrangement with the input connectors, and a measurement circuitry including measurement lines electrically interconnecting the voltage analyzer arrangement with at least one of the input connectors and the output connectors;

wherein the supply lines and the measurement lines are separate lines; and wherein first ends of the supply lines are connected to the alternating voltage generator arrangement and first ends of the measurement lines are connected to the voltage analyzer arrangement, and wherein second ends of both the supply lines and the measurement lines are connected to each other before being commonly connected via a connector line to one of the input connectors or one of the output connectors.

* * * * *